US006146159A

United States Patent [19]

Brunker

[11] Patent Number: 6,146,159

[45] Date of Patent: Nov. 14, 2000

[54] COVER ASSEMBLY FOR WALL MOUNTED ELECTRICAL DEVICE ENCLOSURE

[75] Inventor: Bradley J. Brunker, Madison, Wis.

[73] Assignee: Electronic Theatre Controls, Inc., Middleton, Wis.

[21] Appl. No.: 09/298,378

[22] Filed: Apr. 23, 1999

[51] Int. Cl.[7] ..... H01R 13/44

[52] U.S. Cl. ..... 439/135; 220/241; 174/66

[58] Field of Search ..... 439/135, 142–144; 220/241; 174/66

[56] References Cited

U.S. PATENT DOCUMENTS

| | | | |
|---|---|---|---|
| 998,119 | 7/1911 | Peterson | 174/66 |
| 1,660,346 | 2/1928 | Neal | 174/66 |
| 1,784,277 | 12/1930 | Darlington | 220/241 |
| 1,797,635 | 3/1931 | Buchsbaum | 220/241 |
| 1,840,582 | 1/1932 | Hubbell | 220/241 |
| 2,510,745 | 6/1950 | Kilgore | 220/48 |
| 3,197,549 | 7/1965 | Good | 174/66 |
| 4,451,101 | 5/1984 | Davis | 439/144 |

OTHER PUBLICATIONS

Print dated Nov. 11, 1996 of a prior art ETC faceplate assembly made and sold before the date of the present invention.

BIT7, Inc. faceplate snap concept sketches dated in or about Aug., 1996.

*Primary Examiner*—Renee Luebke
*Assistant Examiner*—Briggitte R. Hammond
*Attorney, Agent, or Firm*—Mason, Kolehmainen, Rathburn & Wyss; Philip M. Kolehmainen

[57] ABSTRACT

A cover assembly for a wall mounted electrical device enclosure includes a mounting bracket that can be attached to the enclosure and a cover plate that is removeably installed onto the mounting bracket. The mounting bracket includes a rigid latch tang and supports an opposed resilient catch. The face plate includes opposed latch recesses. To install the face plate, the resilient catch is engaged with one latch recess and then is resiliently deformed to permit the latch tang to engage the opposed latch recess. The face plate can be removed only by first moving it in the plane of the wall to deform the resilient catch.

8 Claims, 2 Drawing Sheets

COVER ASSEMBLY FOR WALL MOUNTED ELECTRICAL DEVICE ENCLOSURE

FIELD OF THE INVENTION

The present invention relates to an improved assembly for covering an electrical device enclosure that is mounted in a wall.

DESCRIPTION OF THE PRIOR ART

Conventional, industry standard enclosures are mounted in walls and receive electrical devices of many kinds such as receptacles, switches and controls. For safety and in order to prevent tampering, such enclosures are covered, often with a face plate or wall plate. The wall plate is conventionally attached by screws to the enclosure, or in some cases to a bracket or other device mounted in the enclosure. Although this type of wall plate is widely used, it has long been subject to disadvantages. One disadvantage is that assembly of the wall plate to the enclosure is time consuming and difficult because the screws must be positioned and threaded into place. In addition, after assembly the screws are visible. This can result in a cluttered, unattractive appearance. Also, because the attachment screws are visible, the possibility of tampering exists In attempts to solve these long standing problems, a variety of cover assemblies have been suggested. For example, in Davis U.S. Pat. No. 4,451,101 there is disclosed an assembly including a cover plate that is attached to a receptacle. A safety guard plate is pivotally connected to the cover plate and can be pivoted to a closed position in which catches 26 engage a spring loaded release bar. Difficulties with this assembly include its complexity and the fact that the safety guard plate can be moved away from the cover plate simply by pulling it away from the wall.

Kilgore U.S. Pat. No. 2,510,745 discloses a cover assembly including a frame that is captured beneath a conventional wall plate. The frame includes an upper bracket with an upturned portion, and a latch member with a rib portion. The upper end of a cover receives the upper bracket, and the cover is pivoted toward the frame so that the latch member springs into a latching position with the rib latching the cover in place. A difficulty with this assembly is its complexity because a separate release button is used to raise the latch member and release the latch from the cover.

Prior to the present invention Electronic Theatre Controls, Inc. of Middleton, Wis. sold a faceplate assembly including a mounting bracket that was attached to a wall mounted enclosure. A pair of flexible, resilient molded faceplate clips were attached to the mounting bracket by screws. A faceplate was snapped into place over the mounting plate, with latch recesses at opposite ends of the faceplate receiving the faceplate clips. Although this assembly provided the advantage of an attractive uncluttered appearance, it was subject to some problems. It was difficult to assemble and the faceplate clips were fragile and could break, rendering the assembly inoperative.

SUMMARY OF THE INVENTION

A principal object of the present invention is to provide an improved cover assembly for a wall mounted electrical enclosure. Other objects are to provide a cover assembly that is easy to use; to provide an assembly that is rugged and does not have fragile components; to provide an assembly that has an uncluttered and attractive appearance; to provide an assembly in which the fade plate is securely mounted; to provide a cover assembly that is resistant to tampering because the way in which the face plate is released is not apparent; and to provide a cover assembly overcoming problems with covers and cover assemblies used in the past.

In brief, in accordance with the invention there is provided a cover assembly for a wall mounted electrical device enclosure including a mounting bracket adapted to be attached to the enclosure in an orientation generally parallel with the plane of the wall. A face plate is removeably attached to the mounting bracket for covering the enclosure. The face plate has an inner wall overlying the mounting bracket and includes a pair of latch recesses located on the inner wall adjacent opposite ends of the face plate. The recesses face one another along a line generally parallel to the plane of the wall and are spaced apart by a first distance. The mounting bracket includes a substantially rigid lock tang adjacent a first end of the mounting bracket and projecting away from a second end of the mounting bracket. A catch is mounted on the mounting bracket adjacent the second end of the mounting bracket. The catch projects away from the first end of the mounting bracket; and normally is spaced from the rigid lock tang by a second distance larger than the first distance. The catch is resiliently moveable in a plane parallel with the plane of the wall, and is relatively rigid in a plane perpendicular to the plane of the wall. A first of the latch recesses receives the catch. The face plate and catch are moveable parallel to the plane of the wall in order to move the catch relative to the mounting bracket to permit the second of the latch recesses to receive the rigid lock tang.

BRIEF DESCRIPTION OF THE DRAWING

The present invention together with the above and other objects and advantages may best be understood from the following detailed description of the preferred embodiment of the invention illustrated in the drawings, wherein.

DETAILED DESCRIPTION OF THE PREFERRED EMBODIMENTS

Figure 1:
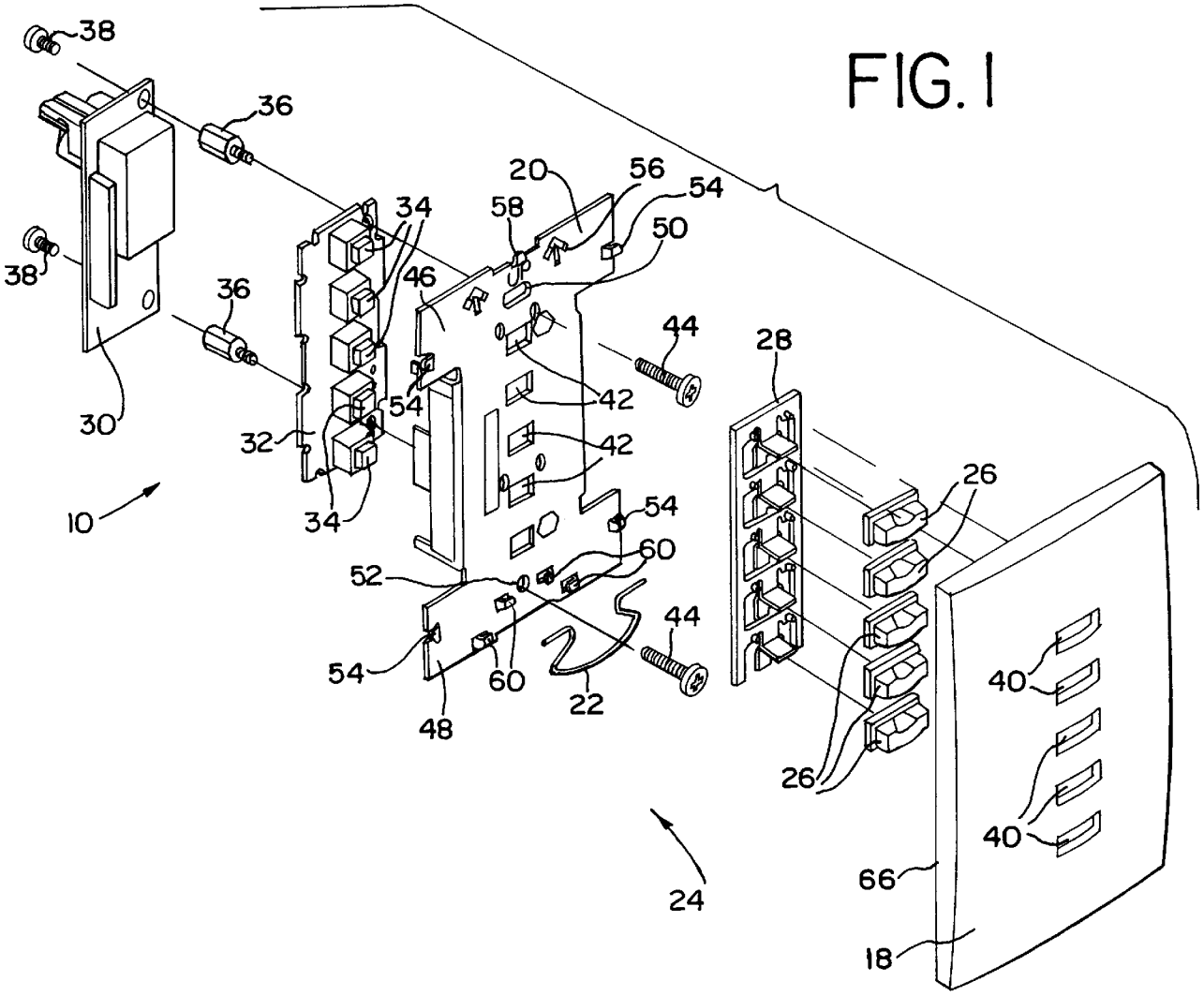
FIG. 1 is an exploded isometric view of components of a wall mounted electrical device assembly including a cover assembly in accordance with the present invention.

Having reference now to the drawings, and initially to FIG. 1, there are seen components of an electrical device assembly generally designated as 10 and including a cover assembly generally designated as 12 constructed in accordance with the principles of the present invention. The assembly 10 is supported by and largely received within a conventional enclosure or "junction box" 14 mounted in a wall 16 (FIGS. 2 and 4).

The cover assembly 12 of the present invention includes a face plate 18 and a mounting bracket 20 supporting a catch spring 22. The assembly 12 can be adapted to and used with many types of wall mounted electrical devices and assemblies. For purposes of illustration, FIG. 1 shows the cover assembly 12 used with a wall mounted control station 24 of an automated lighting control system. The exemplary control station 24 includes a number of user operated key caps 26 supported by a cantilever support 28 sandwiched between the face plate 18 and the mounting bracket 20. A node processor board 30 and a gang switch board 32 including switches 34 are mounted behind the mounting bracket 20 by fasteners 36 and 38. A user can input control signals to the automated lighting control system by pressing the key caps 26 to operate switches 34. The resulting control signals are linked to the automated system through he processor board 30 and electrical connectors (not shown).

In this exemplary assembly, the face plate 18 includes openings 40 through which the key caps 26 extend for access by the user. The mounting bracket 20 includes openings 42 through which the switches 34 project in order to be operated by the key caps 26. As can be readily understood by one of ordinary skill, the principles of the invention can be applied to cover assemblies of many sizes and types by simple modifications of the mounting bracket and face plate. The number and the location of access openings in the face plate are tailored to the requirements of any particular electrical device or assembly. The number and location of openings in or other mating structures of the mounting bracket are similarly matched with the requirements of a particular device or assembly.

Figures 2, 3, 4, 5, 6:
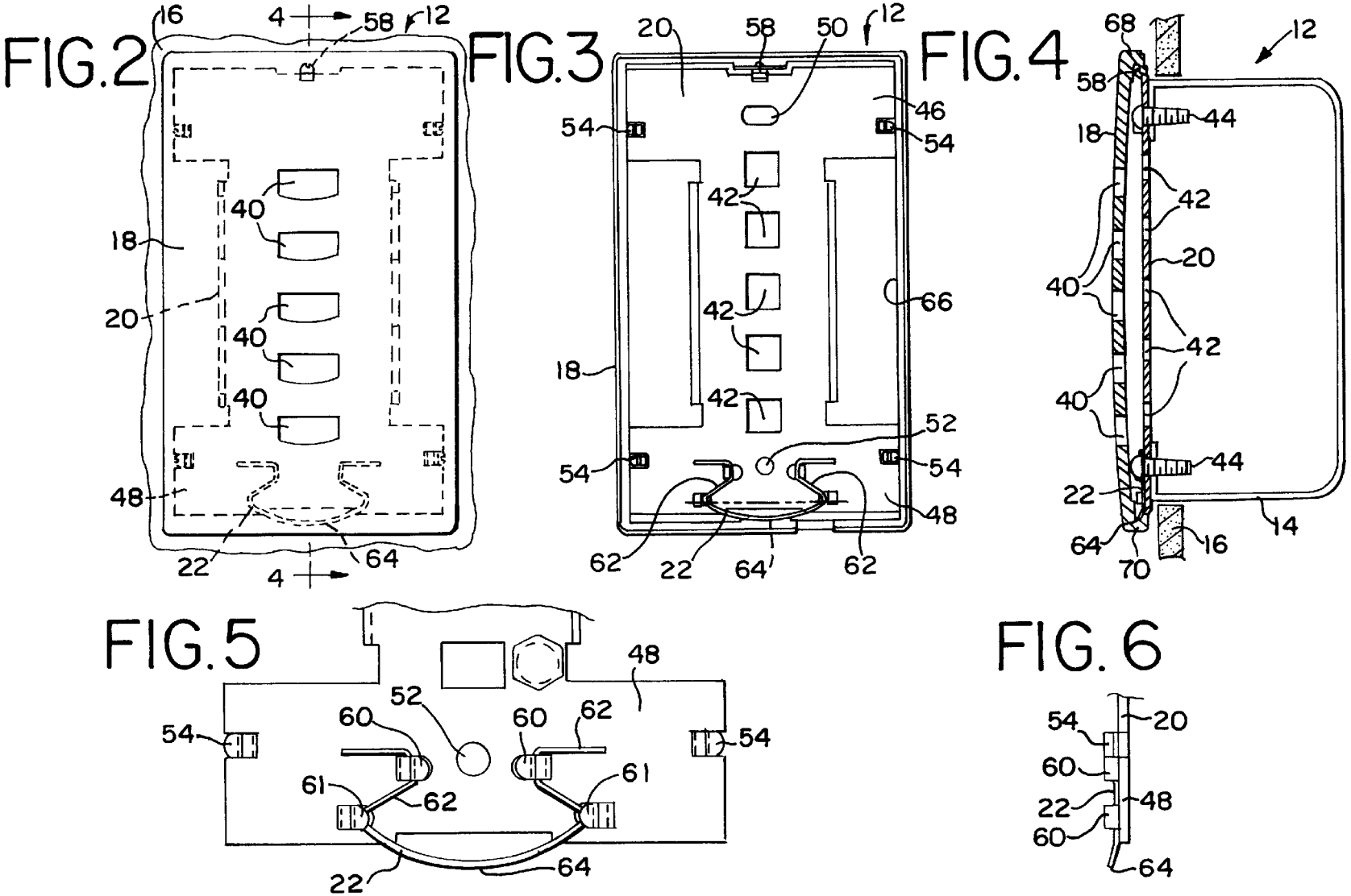
FIG. 2 is a front elevational view of the cover assembly.
FIG. 3 is a rear elevational view of the cover assembly.
FIG. 4 is a cross sectional view of the cover assembly taken along the line 4—4 of FIG. 2.
FIG. 5 is an enlarged, fragmentary view of the a spring catch and a portion of the mounting bracket of the cover assembly.
FIG. 6 is a side view of the structure seen in FIG. 5.

FIGS. 2–4 illustrate the cover assembly with the remaining components of the control station 24 omitted for clarity. As is conventional, any standard enclosure 14 is mounted at an opening in the wall 16. Then the mounting bracket 20 is attached to the enclosure 14 by fasteners 44 (FIGS. 1 and 4). In accordance with the invention, the face plate 18 is then quickly and easily attached to the mounting bracket 20 to provide a clean and attractive appearance and a tamper resistant installation.

The mounting bracket 20 is preferably a stamped and formed sheet metal part with upper and lower body portions 46 and 48 including openings 50 and 52 receiving the mounting fasteners 44. Alignment tabs 54 project forward from the plane of the mounting bracket 20 to assist in positioning and holding the face plate 18. Indicia 56 (FIG. 1) aid the installer in properly orienting the mounting bracket on the enclosure 14. A latch tang 58 is formed at the upper body portion 46. Tang 58 may be similar to the alignment tabs 54 and extends up slightly from the upper edge of the upper mounting portion 46 and also projects slightly forward. A pair of upper mounting tabs 60 and a pair of lower mounting tabs 61 extend from the surface of the lower body portion 48.

The catch spring 22 is a formed wire clip having an opposed pair of mounting legs 62 and a central catch portion 64. Each of the legs 62 engages a pair of the mounting tabs 60 to securely mount the catch spring 22 on the surface of the lower body portion 48 of the mounting bracket 20. As seen in FIG. 6, the legs 62 of the catch spring lie in a flat plane at the front surface of the mounting bracket 20, and the catch portion is permanently deformed to slope out of that flat plane. The catch portion 64 therefore extends down slightly beyond the lower edge of the lower body portion 48, and also projects slightly forward.

The flexible catch spring 22 has a shape similar to the Greek letter omega. The upper mounting tabs 60 engage the neck of the spring, between the enlarged body portion and the ends of the spring. This engagement holds the spring in place on the mounting bracket 20. The lower mounting tabs 61 overlie the opposed sides of the enlarged body portion with sufficient clearance not to interfere with flexing of the catch spring 22. When the catch portion 64 is displaced upwardly, the opposed sides of the enlarged body portion move laterally outward toward the bases of the lower tabs 61. The lower tabs do not constrain this movement, but do provide a robust assembly by preventing movement of the catch spring portion 64 upwardly from the mounting bracket 20.

The face plate 18 may be a molded plastic part or may be formed in various ways of other decorative materials. The face plate 18 is large enough to cover the mounting bracket and the enclosure 14 to provide an attractive appearance on the surface of the wall 16. A flange 66 extends around the periphery of the face plate 18.. Along its top edge, an upper latch recess 68 is provided. A similar lower latch recess 70 is provided along the lower edge of the face plate 18. The recesses 68 and 70 face or open toward one another.

To mount the face plate 18 onto the mounting plate 20, the catch portion 64 of the catch spring 22 is inserted into the lower latch recess 70 of the face plate. This is done by holding the face plate 18 at an angle to the plane of the wall 16, with the bottom edge of the face plate 18 against the wall below the mounting bracket 20. Then the face plate is moved upwardly until the lower latch recess 70 receives the catch portion 64 of the catch spring 22.

The catch spring 22 is resilient and can be resiliently deformed in the plane of the wall 16. The face plate 18 is moved further upward after the catch portion 64 enters the lower latch recess 70. This movement is permitted by resilient deformation of the catch spring 22. This upward movement permits the upper latch recess 68 of the face plate 18 to clear the end of the latch tang 58 at the top of the mounting bracket 20. The face plate 18 can be moved against the surface of the wall 16 with the latch tang 58 aligned with the upper latch recess 68. When the face plate is released, the catch spring returns toward its original shape and moves the face plate 18 down as the latch tang 58 enters the upper latch recess 68. The face plate 18 is resiliently drawn both downward and also inward toward the wall 16 and mounting bracket 20.

This installation procedure is simple and quick. When installed, the face plate is held firmly in position on the surface of the wall 16. When the face plate 18 is in place, the alignment tabs 54 engage the flange 66 to position the face plate 18 and to cooperate with the upper and lower latch recesses 68 and 70 and with the latch tang 58 and catch portion 64 to hold the face plate 18 solidly in place (FIG. 3).

When assembled, no fasteners or other attaching structures are visible. Therefore the cover assembly provides a neat and attractive appearance. In addition, the installed cover assembly 12 is highly resistant to tampering. The tabs 54, 58 and 60 and the catch spring 22 are rugged and provide a sturdy assembly. Because the attachment structure is entirely hidden under the face plate 18, an observer cannot visually determine how the face plate 18 can be removed.

The installed face plate 18 cannot be removed by pulling it away from the wall. The catch spring 22 is able to flex in the direction parallel to the plane of the wall because of the way it is shaped and mounted. However, it cannot flex significantly in the transverse direction. The catch portion 64 is captured within the lower latch recess 70, and the recess 70 does not include a cam surface or other structure that permits the catch spring 22 to flex in response to movement of the face plate 18 away from the wall 16. Therefor the engagement of the catch portion 64 in the recess 70 and the engagement of the latch tang 58 in the recess 68 prevent the face plate from being moved in the direction perpendicular to the plane of the wall 16. In addition, the engagement of the alignment tabs 54 with the peripheral flange 66 prevents movement of the face plate 18 from side to side. The engagement of the latch tang 58 in the upper latch recess 68 prevents upward movement of the face plate 18.

In order to remove the face plate 18 from the surface of the wall 16, it is first necessary to move the face plate 18 in the direction of the plane of the wall 16, downward along the surface of the wall 16. This movement compresses the catch spring 22 and permits the upper latch recess 68 to move clear of the latch tang 58. When this clearance is achieved by resilient deformation of the catch spring 22, the upper end of the face plate 18 can be pivoted away from the surface of the wall 16, and then the face plate can be moved down to free the catch portion 64 from the lower latch recess 70. This required movement to separate the face plate 18 from the mounting bracket 20 is not apparent to or easily discovered by an observer and contributes to the advantage that the cover assembly 12 is resistant to tampering.

While the present invention has been described with reference to the details of the embodiment of the invention shown in the drawing, these details are not intended to limit the scope of the invention as claimed in the appended claims.

What is claimed is:

1. A cover assembly for a wall mounted electrical device enclosure, the wall having a plane, said assembly comprising:

a mounting bracket adapted to be attached to the enclosure in an orientation parallel with the plane of the wall; and a face plate removeably attached to said mounting bracket for covering the enclosure, said face plate having an inner wall overlying said mounting bracket;

said face plate including first and second latch recesses located on said inner wall adjacent opposite ends of said face plate, said recesses facing one another along a line parallel to the plane of the wall and being spaced apart by a first distance;

said cover assembly being characterized by:

said mounting bracket including a rigid lock tang adjacent a first end of said mounting bracket and projecting away from a second end of said mounting bracket; and a catch mounted on said mounting bracket adjacent said second end of said mounting bracket, said catch projecting away from said first end of said mounting bracket; and normally being spaced from said rigid lock tang by a distance larger than said first distance;

said catch being resiliently moveable in a plane parallel with the plane of the wall, and said catch being relatively rigid in a plane perpendicular to the plane of the wall;

said first of said latch recesses receiving said catch, said face plate and catch being moveable parallel to the plane of the wall in order to move said catch relative to said mounting bracket to permit said second of said latch recesses to receive said rigid lock tang.

2. The cover assembly as claimed in claim 1, wherein said latch recesses being similar to one another.

3. The cover assembly as claimed in claim 1, wherein said catch comprising a spring.

4. The cover assembly as claimed in claim 3, wherein said recesses, rigid lock tang and spring being shaped to pull said face plate toward said mounting bracket.

5. The cover assembly as claimed in claim 3, wherein said spring comprising a wire form oriented generally in a plane parallel to the plane of the wall.

6. The cover assembly as claimed in claim 5, wherein said mounting bracket comprising a stamped and formed sheet metal body having a plurality of formed lance members, one of said lance members being said rigid lock tang and others of said lance members capturing said wire form spring.

7. The cover assembly as claimed in claim 6, still others of said lance members engaging said face plate to limit movement of said face plate in the plane of said wall.

8. A cover assembly for a wall mounted electrical device enclosure, the wall having a plane, said assembly comprising:

a mounting bracket adapted to be attached to the enclosure in an orientation parallel with the plane of the wall; and a face plate removeably attached to said mounting bracket for covering the enclosure, said face plate having an inner wall overlying said mounting bracket;

said face plate including first and second latch recesses located on said inner wall adjacent opposite ends of said face plate, said recesses facing one another along a line parallel to the plane of the wall and being spaced apart by a first distance;

said cover assembly being characterized by:

said mounting bracket including a rigid lock tang adjacent a first end of said mounting bracket and projecting away from a second end of said mounting bracket, said locking tang being received in said first of said latch recesses; and a catch mounted on said mounting bracket adjacent said second end of said mounting bracket, said catch projecting away from said first end of said mounting bracket; and normally being spaced from said rigid lock tang by a distance larger than said first distance, said catch being received in said second of said latch recesses;

said catch being resiliently moveable in a plane parallel with the plane of the wall, and said catch and said second latch recess being shaped to prevent flexing of said catch in response to movement of said face plate in a direction perpendicular to the plane of the wall;

said face plate and catch being moveable parallel to the plane of the wall in order to move said catch relative to said mounting bracket and permit said second of said latch recesses to move free of said rigid lock tang.

* * * * *